US009079406B2

(12) United States Patent
Yamamoto et al.

(10) Patent No.: US 9,079,406 B2
(45) Date of Patent: Jul. 14, 2015

(54) INKJET PRINTING APPARATUS AND NOZZLE-CLEANING METHOD THEREOF

(75) Inventors: Takaharu Yamamoto, Kyoto (JP); Ryoichi Naoe, Kyoto (JP); Katsuaki Takeuchi, Kyoto (JP)

(73) Assignee: Screen Holdings Co., Ltd., Kyoto (JP)

( * ) Notice: Subject to any disclaimer, the term of this patent is extended or adjusted under 35 U.S.C. 154(b) by 0 days.

(21) Appl. No.: 14/004,134

(22) PCT Filed: Sep. 22, 2011

(86) PCT No.: PCT/JP2011/005350
§ 371 (c)(1),
(2), (4) Date: Sep. 9, 2013

(87) PCT Pub. No.: WO2012/131813
PCT Pub. Date: Oct. 4, 2012

(65) Prior Publication Data

US 2014/0009534 A1 Jan. 9, 2014

(30) Foreign Application Priority Data

Mar. 28, 2011 (JP) ..... 2011-069881

(51) Int. Cl.
*B41J 2/165* (2006.01)
*B41J 2/21* (2006.01)
(Continued)

(52) U.S. Cl.
CPC ..... *B41J 2/1652* (2013.01); *B41J 2/16526* (2013.01); *B41J 2/16579* (2013.01);
(Continued)

(58) Field of Classification Search
CPC ..... B41J 2/165; B41J 2/1652; B41J 2/16579; B41J 2/175; B41J 2/2142
USPC ..... 347/35
See application file for complete search history.

(56) References Cited

U.S. PATENT DOCUMENTS

2010/0321431 A1* 12/2010 Mori ..... 347/9
2011/0050768 A1 3/2011 Itogawa

FOREIGN PATENT DOCUMENTS

JP 10-119307 5/1998
JP 2001-113725 4/2001
(Continued)

OTHER PUBLICATIONS

International Search Report for Application No. PCT/JP2011/005350 dated Dec. 27, 2011.
(Continued)

*Primary Examiner* — Alessandro Amari
*Assistant Examiner* — Michael Konczal
(74) *Attorney, Agent, or Firm* — Dorsey & Whitney LLP

(57) ABSTRACT

A controller in the example of this invention operates to perform flushing by ejecting three types in size of ink droplets, i.e., smaller, middle and larger ink droplets, from each of nozzles. Then the controller operates an ink-droplet detector to perform an ejection test to detect ejection conditions. Thereafter, the controller operates an ink supply section to perform cleaning in accordance with results of the test. A combination in size of unejected ink droplets indicates a defective condition of the nozzle. Consequently, varying the degree of cleaning the nozzles in accordance with the size of the unejected ink droplets may achieve cleaning in a shorter time of period. As a result, time for cleaning the nozzle can be suppressed. This leads to a decreased proportion of maintenance to a starting time in an apparatus and increased availability of the apparatus.

15 Claims, 6 Drawing Sheets

(51) Int. Cl.
*B41J 2/175* (2006.01)
*B41J 29/38* (2006.01)

(52) U.S. Cl.
CPC ..... *B41J2/16585* (2013.01); *B41J 2/175* (2013.01); *B41J 2/2132* (2013.01); *B41J 2/2139* (2013.01); *B41J 2/2142* (2013.01); *B41J 29/38* (2013.01)

(56) References Cited

FOREIGN PATENT DOCUMENTS

| | | | | |
|---|---|---|---|---|
| JP | 2003-127430 | | | 5/2003 |
| JP | 2004-042281 | | | 2/2004 |
| JP | 2005-186381 | | | 7/2005 |
| JP | 2006-173929 | | | 6/2006 |
| JP | 2006-240119 | | | 9/2006 |
| JP | 2007-007960 | | | 1/2007 |
| JP | 2007090639 | A | * | 4/2007 |
| JP | 2008-162148 | | | 7/2008 |
| JP | 2008-168565 | | | 7/2008 |
| JP | 2010-030184 | | | 2/2010 |
| JP | 2010-058463 | | | 3/2010 |
| JP | 2010058463 | A | * | 3/2010 |

OTHER PUBLICATIONS

Extended European Search Report for EP Appl. No. 11861921.2 mailed on Sep. 30, 2014, pp. 1-8.

* cited by examiner

INKJET PRINTING APPARATUS AND NOZZLE-CLEANING METHOD THEREOF

CROSS-REFERENCE TO RELATED APPLICATION

This application claims priority to PCT Application No. PCT/JP2011/005350 filed on Sep. 22, 2011, which claims priority to Japanese Application No. JP2011-069881 filed Mar. 28, 2011. These applications are incorporated by reference herein in their entirety and for all purposes.

TECHNICAL FIELD

This invention relates to an inkjet printing apparatus for performing printing on printing paper by ejecting ink droplets from an inkjet head while moving the inkjet head and the printing paper relative to each other, and to a nozzle cleaning method of the inkjet printing apparatus.

BACKGROUND

Examples of such a conventional apparatus of this type include an apparatus that performs printing on printing paper by ejecting ink droplets from each of nozzles in an inkjet head while moving the printing paper relative to the inkjet head. An inkjet printing apparatus typically includes an inkjet head with a plurality of minute nozzles from each of which ink droplets are ejected. Consequently, in the inkjet printing apparatus, nozzle clogging may occur due to dust or increased viscosity of the ink droplets. Performing printing in the state above may cause no ejection of ink droplets. This leads to some white lines on the printing paper. The printing paper with such white lines is regarded as defective and to be discarded.

Then, the conventional inkjet printing apparatus performs an ejection test for detecting a non-ejection nozzle. When a non-ejection nozzle is detected, purge for discharging ink droplets from the nozzle by suction or pressure is performed to clean the nozzle. The purge eliminates the unejected ink droplets, and thus printing enables to be performed normally with a nozzle through which ink droplets are normally ejected.

The ejection test above is for example performed as under.

A light receiver and a light projector are disposed in face-to-face relationship in a direction where a plurality of nozzles is arranged. Then ink droplets are ejected from each of the nozzles in turn and are to be detected by the light receiver. From conditions detected by the light receiver, it is detected whether or not the ink droplets are ejected. When a non-ejection nozzle is found, the nozzle is cleaned. See, for example, Japanese Patent Publications No. H10-119307A, 2001-113725A, and 2003-127430A.

Moreover, when an inkjet head is provided that ejects ink heated by a heater disposed in the nozzle, infrared rays are emitted from the ink droplets, and thus an infrared sensor detects a non-ejection nozzle. See, for example, Japanese Patent Publication No. 2004-42281A.

Moreover, when a plurality of inkjet heads is provided, an ejection test is performed while a light projector, a light receiver, and a light reflector are disposed. See, for example, Japanese Patent Publication No. 2005-186381A. Furthermore, a light projector and a light receiver are disposed orthogonally relative to a direction where the nozzles of the inkjet head are arranged. An ejection test enables to be performed during printing. See, for example, Japanese Patent Publication No. 2006-240119A.

The examples of the conventional apparatus with such the constructions, however, have the following drawbacks. That is, in the conventional apparatus, the ejection test is performed and when a non-ejection nozzle is found, the non-ejection nozzle is cleaned independently of the number of non-ejection nozzles. As a result, a proportion of maintenance to a starting time may increase in the inkjet printing apparatus. This may lead a drawback that availability of the inkjet printing apparatus decreases.

This invention has been made regarding the state of the art noted above, and its object is to provide an inkjet printing apparatus and a nozzle cleaning method of the apparatus. The apparatus allows a decreased proportion of maintenance to a starting time in the apparatus and thus increased availability of the apparatus by performing cleaning in accordance with results of an ejection test with variations in size of ink droplets.

SUMMARY

This invention is constituted as stated below to achieve the above object.

One example of this invention discloses an inkjet printing apparatus that performs printing while moving an inkjet head and printing paper relatively to each other. The apparatus includes an inkjet head with a plurality of nozzles, the nozzles being arranged in a width direction of the printing paper orthogonal to a relative movement direction of the printing paper and enabling to eject ink droplets of at least two sizes; an ink-droplet detector configured to detect an ejection condition of ink droplets from each of the nozzles; a non-ejection recovering device configured to recover non-ejection of ink droplets from each of the nozzles; and a controller configured to perform flushing that ejects the ink droplets of at least two sizes from each of the nozzles, to operate the ink-droplet detector to perform an ejection test for detecting the ejection condition of each of the nozzles, and to operate the non-ejection recovering device to perform cleaning in accordance with results of the ejection test.

[Effect] The controller in the example of this invention operates to perform flushing that ejects ink droplets of at least two sizes from each of the nozzles, operates the ink-droplet detector to perform the ejection test for detecting the ejection condition of each of the nozzles, and operates the non-ejection recovering device to perform cleaning in accordance with results of the ejection test. A combination in size of the ink droplets unejected indicates a defective condition of the nozzle. Consequently, varying the degree of cleaning the nozzle in accordance with the size of the unejected ink droplets may achieve cleaning in a shorter time of period. As a result, time for cleaning the nozzle can be suppressed. This leads to a decreased proportion of maintenance to a starting time in the apparatus and increased availability of the apparatus.

Moreover, the non-ejection recovering device has a function of cleaning each of the nozzles by purge that discharges the ink droplets, and enables to perform weak purge as weak cleaning and strong purge stronger than the weak purge. The controller performs the ejection test of ejecting smaller and larger ink droplets relative to each of the nozzles prior to printing. When only the smaller ink droplets are unejected, the controller operates to perform the weak purge. When the smaller ink droplets as well as the larger droplets are unejected, the controller operates to perform the strong purge. Such construction is preferable.

With the above construction, prior to printing, the weak purge is performed when only the smaller ink droplets are unejected, whereas the strong purge is performed when the smaller ink droplets and the larger ink droplets are unejected. Thus, the weak purge performed when only the smaller ink droplets are unejected achieves a less purge time than that when the smaller ink droplets and the larger ink droplets are unejected. Consequently, time for cleaning the nozzle can be suppressed in accordance with a condition of the non-ejection nozzle.

Moreover, the non-ejection recovering device has a function of cleaning each of the nozzles by purge that discharges ink droplets, and enables to perform the weak purge as weak cleaning, middle purge stronger than the weak purge, and the strong purge stronger than the middle purge. The controller performs the ejection test of ejecting the smaller, middle, and larger ink droplets from each of the nozzles prior to printing. When only the smaller ink droplets are unejected, the controller operates to perform the weak purge. When the smaller ink droplets and the middle ink droplets are unejected, and only larger ink droplets are ejected, the controller operates to perform the middle purge. When the smaller, middle, and larger ink droplets are all unejected, the controller operates to perform the strong purge. Such construction is preferable.

With the above construction, prior to printing, the weak purge is performed when only the smaller ink droplets are unejected. The middle purge is performed when the smaller ink droplets and the middle ink droplets are unejected, and only the larger ink droplets are ejected. The strong purge is performed when the smaller, middle, and larger ink droplets are all unejected. Thus, the weak purge performed when only the smaller ink droplets are unejected achieves a less purge time than that when the smaller ink droplets and the middle ink droplets are unejected and the larger ink droplets are ejected, or than that when the smaller, middle, and bigger ink droplets are all unejected. Consequently, time for cleaning the nozzle can be suppressed in accordance with a condition of the non-ejection nozzle.

Moreover, the controller preferably performs the ejection test and then performs any of the purges, and thereafter performs again the ejection test to start printing only when all types in size of ink droplets are ejected.

With the above construction, the ejection test prior to the printing causes the printing to start only when all types in size of ink droplets are ejected. This achieves printing of high quality.

Although it is determined through the ejection test that only the smaller ink droplets are unejected from the nozzles, the controller operates to perform the strong purge when the non-ejection nozzles are collected within a given area.

When the non-ejection nozzles with unejected smaller ink droplets are collected in a given area, the collected nozzles may have a more significant reason for non-ejection than that of non-ejection nozzles distributed. Consequently, it may be considered that non-ejection is not recovered by the small purge, and thus the strong purge should be performed. As a result, increased accuracy of recovering the non-ejection can be obtained.

Moreover, although it is determined through the ejection test that only the smaller ink droplets are unejected or the smaller ink droplets and the middle ink droplets are unejected from the nozzles, the controller operates the to perform the strong purge when the non-ejection nozzles are collected within a given area.

Moreover, when only the smaller ink droplets are unejected or the smaller ink droplets and the middle ink droplets are unejected, the nozzles with such ink droplets that are collected within a given area may have a more significant reason for non-ejection than that of non-ejection nozzles distributed. Consequently, it may be considered that non-ejection is not recovered by the small or middle purge, and thus the strong purge should be performed. As a result, increased accuracy of recovering the non-ejection can be obtained.

Moreover, the controller performs the ejection test during printing between printing areas of the printing paper. The controller operates to perform printing continuously by nozzles adjacent to and replaced with the non-ejection nozzles when it is determined through the ejection test that only the smaller ink droplets are unejected, and the controller operates to perform the strong purge firstly and then stop the printing when it is determined that the larger ink droplets are unejected. Such configuration is preferable.

When only the smaller ink droplets are unejected, printing continuously performed by nozzles adjacent to and replaced with the non-ejection nozzles also enables to suppress deterioration of printing quality. When the larger ink droplets are unejected, however, replacement with the adjacent nozzles causes deterioration of printing quality. Then, the strong purge is firstly performed, and thereafter printing is stopped. Consequently, when non-ejection is slightly performed, printing is continuously performed by the adjacent nozzles instead of the non-ejection nozzles. This achieves increased availability. Moreover, when non-ejection is largely performed, printing is stopped. This enables to avoid continuous printing with deteriorated printing quality.

Moreover, the controller performs the ejection test during printing between printing areas of the printing paper. The controller operates to perform printing continuously by nozzles adjacent to and replaced with the non-ejection nozzles when it is determined through the ejection test that only the smaller ink droplets are unejected. The controller operates to perform printing continuously by the adjacent nozzles when it is determined that the smaller ink droplets and the middle ink droplets are unejected. The controller operates to perform the strong purge and thereafter to stop the printing when it is determined that the larger ink droplets are unejected. Such configuration is preferable.

When only the smaller ink droplets are unejected, printing continuously performed by the adjacent nozzles instead of the non-ejection nozzles also enables to suppress deterioration of printing quality. Moreover, when the smaller ink droplets and the middle ink droplets are unejected, continuous printing by the adjacent nozzles enables to suppress deterioration of printing quality. When larger ink droplets are unejected, however, replacement with the adjacent nozzles causes deterioration of printing quality. Then, the strong purge is firstly performed, and thereafter printing is stopped. Consequently, when non-ejection is slightly performed, printing is continuously performed by the adjacent nozzles instead of the non-ejection nozzles. This achieves increased availability. Moreover, when non-ejection is largely performed, printing is stopped. This enables to avoid continuous printing with deteriorated printing quality.

Another example of this invention discloses a nozzle cleaning method in an inkjet printing apparatus that performs printing while moving an inkjet head and printing paper relatively to each other, the inkjet head having a plurality of nozzles arranged in a width direction of the printing paper orthogonal to a relative movement direction of the printing paper and enabling to eject the ink droplets of at least two sizes. The method includes a flushing step of ejecting ink droplets of at least two sizes from each of the nozzles; an ejection-test performing step of detecting an ejection condition of each of the nozzles; and a non-ejection recovering step of performing cleaning for recovering ejection of the ink droplets in accordance with results of the ejection test.

[Effect] In the example of this invention, the ink droplets of at least two sizes are ejected from each of the nozzles in the flushing step. Then the ejection condition on each of the nozzles is detected in the ejection-test performing step. Thereafter, ejection of the ink droplets is recovered in the non-ejection recovering step in accordance with results of the ejection test. A combination in size of unejected ink droplets indicates a defective condition of the nozzle. Consequently, varying the degree of cleaning the nozzle in accordance with the sizes of unejected ink droplets may achieve cleaning in a shorter time of period. As a result, time for cleaning the nozzle can be suppressed. This leads to a decreased proportion of maintenance to a starting time in the apparatus and increased availability of the apparatus.

The controller of the inkjet printing apparatus according to this invention operates to perform flushing that ejects the ink droplets of at least two sizes from each of the nozzles, operates the ink-droplet detector to perform the ejection test for detecting the ejection condition, and operates the non-ejection recovering device to perform cleaning in accordance with results of the ejection test. A combination in size of unejected ink droplets indicates a defective condition of the nozzle. Consequently, varying the degree of cleaning the nozzles in accordance with the size of unejected ink droplets may achieve cleaning in a shorter time of period. As a result, time for cleaning the nozzle can be suppressed. This leads to a decreased proportion of maintenance to a starting time in the apparatus and increased availability of the apparatus.

DETAILED DESCRIPTION

One example of this invention will be described hereinafter with reference to the drawings.

Figure 1:
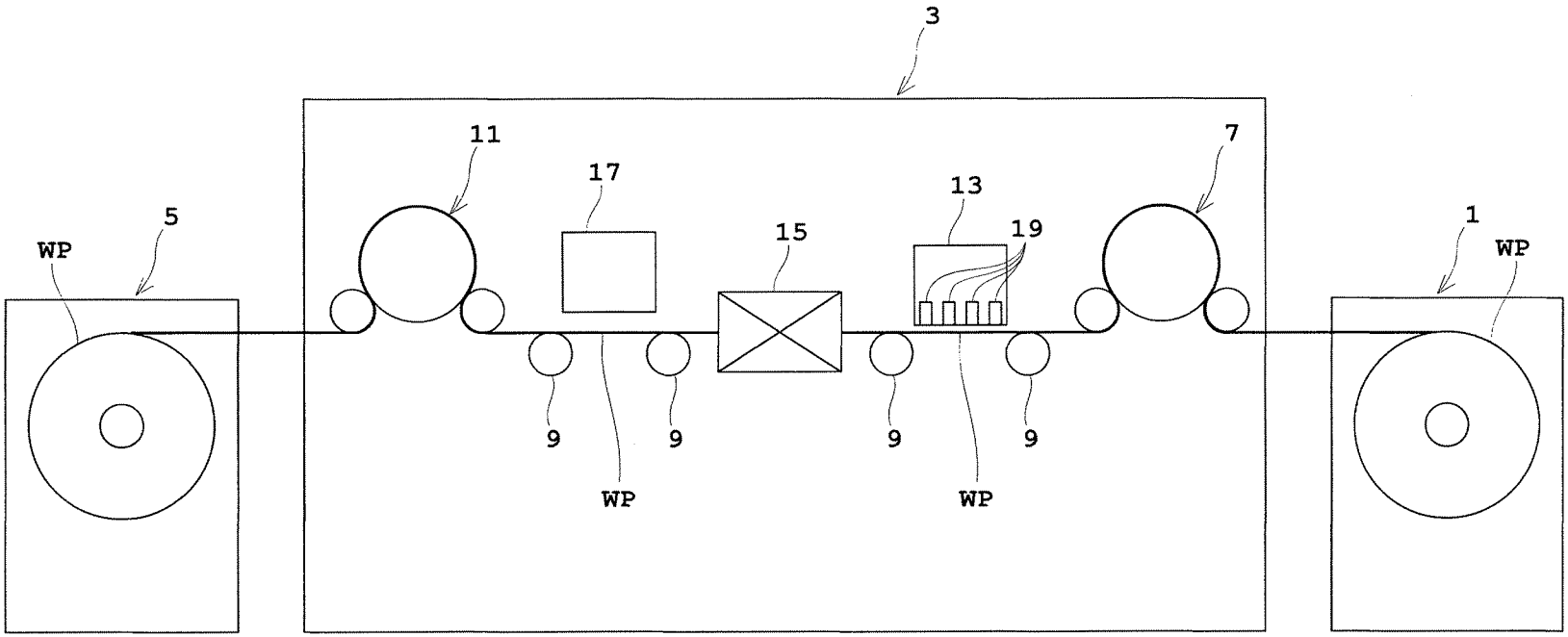
FIG. 1 is a schematic view illustrating an entire inkjet printing system according to one example of this invention.

FIG. 1 is a schematic view illustrating an entire inkjet printing system according to one example of this invention.

The inkjet printing according to one example of this invention includes a paper feeder 1, an inkjet printing apparatus 3, and a take-up roller 5. The paper feeder 1 feeds web paper WP in a roll form. The inkjet printing apparatus 3 performs printing on the web paper P. The take-up roller 5 winds up the printed web paper WP into a roll form.

The paper feeder 1 holds the web paper WP in the roll form to be rotatable about a horizontal axis, and unwinds and feeds the web paper WP to the inkjet printing apparatus 3. The take-up roller 5 winds up the web paper WP printed by the inkjet printing apparatus 3 about a horizontal axis. Regarding the side from which the web paper WP is fed as upstream and the side to which the web paper is taken up as downstream, the paper feeder 1 is disposed upstream of the inkjet printing apparatus 3 while the take-up roller 5 is disposed downstream of the inkjet printing apparatus 3.

The inkjet printing apparatus 3 includes a drive roller 7 in an upstream position thereof. The drive roller 7 takes the web paper WP from the paper feeder 1. The web paper WP unwound from the paper feeder 1 by the drive roller 7 is transported downstream toward the take-up roller 5 on a plurality of transport rollers 9. A drive roller 11 is disposed between the most downstream transport roller 9 and the take-up roller 5. The drive roller 11 feeds the web paper WP travelling on the transport rollers 9 toward the take-up roller 5.

Between the drive roller 7 and the drive roller 11, the inkjet printing apparatus 3 includes a printing unit 13, a drying unit 15, and an inspecting unit 17 arranged in this order from upstream to downstream. The drying unit 15 dries portions printed by the printing unit 13. The inspecting unit 17 inspects the printed portions for any stains or missing.

The printing unit 13 includes inkjet heads 19 for discharging ink droplets. The printing unit 13 typically includes a plurality of printing heads being arranged in the transport direction of the web paper WP. For instance, four printing units 13 are provided separately for black (K), cyan (C), magenta (M), and yellow (Y). However, in order to facilitate understanding of the invention, the following description will be given on the assumption that only one printing unit 13 is provided. The printing unit 13 has a plurality of inkjet heads 19 arranged also in a horizontal direction orthogonal to the transport direction of the web paper WP. The printing unit 13 has enough inkjet heads 19 to perform printing without moving over a printing area in the width direction of the web paper WP. That is, the inkjet printing apparatus 3 in this example performs printing on the web paper WP being fed thereto, with the inkjet heads 19 not moving for primary scanning but remaining stationary in the horizontal direction orthogonal to the transport direction of the web paper WP.

Figures 2A, 2B, 2C, 2D:
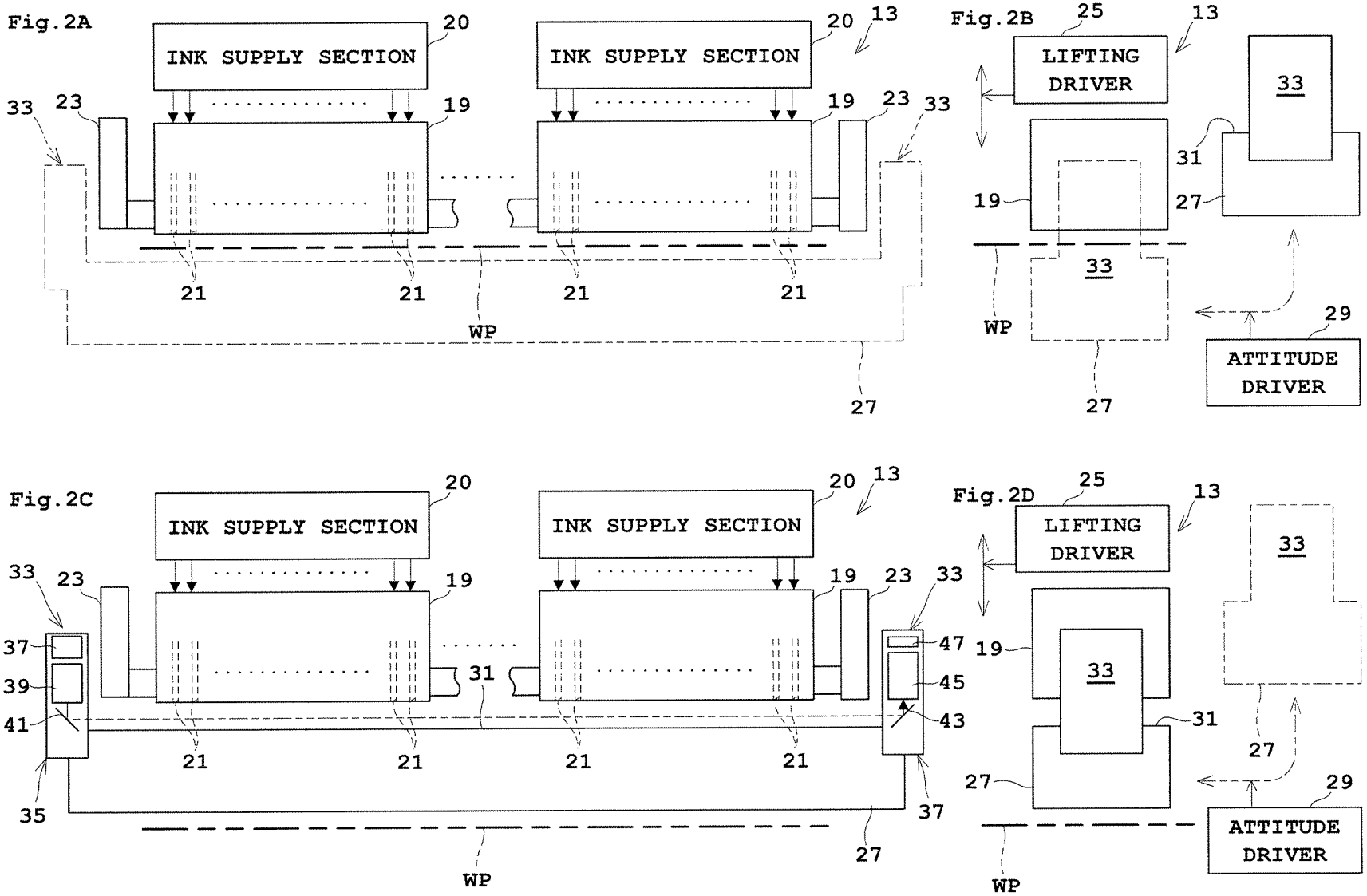
FIG. 2 is a schematic view illustrating a printing unit: 2A and 2B illustrating the unit during printing, and 2C and 2D illustrating the unit during maintenance.

Here, description will be given in detail of the printing unit 13 with reference to FIG. 2. FIG. 2 is a schematic view illustrating the printing unit 13. FIGS. 2A and 2B illustrate the unit during printing, whereas FIGS. 2C and 2D illustrate the unit during maintenance. Here, FIGS. 2A and 2B each illustrate the printing unit 13 seen from the upstream in FIG. 1. FIGS. 2B and 2D each illustrate the unit seen in a direction perpendicular to the plane of FIG. 1.

The printing unit 13 includes a plurality of inkjet heads 19. Each inkjet head 19 has a plurality of nozzles 21 arranged in the width direction of the web paper WP orthogonal to the transport direction of the web paper WP. Each nozzle 21 is called a variable nozzle, and enables to eject ink droplets of at least two sizes. Each inkjet head 19 is attached to a nozzle frame 23. An ink supply section 20 supplies ink droplets to the inkjet head 19. The ink supply section 20 has a function of not only supplying ink droplets but also performing "purge", to be mentioned later.

Here, the ink-droplet supply section 20 mentioned above corresponds to a "non-ejection recovering device" in this invention.

The head frame 23 moves upward and downward by a lifting driver 25. Specifically, the head frame 23 moves upward and downward between a printing position and a maintenance position. As illustrated in FIGS. 2A and 2B, the printing position is in a level where a lower surface of the inkjet head 19 is close to the web paper WP. As illustrated in FIGS. 2C and 2D, the maintenance position is in a level where the lower surface 19 of the inkjet head 19 is over the printing position.

A maintenance frame 27 is disposed close to the head frame 23. The maintenance frame 27 is moved by an attitude driver 29. Specifically, the maintenance frame 27 is lifted while being moved forward and backward between the printing position and the maintenance position in conjunction with upward and downward movement of the head frame 23. More specifically, when the inkjet head 19 is in the printing position, the maintenance frame 27 is moved behind the inkjet head 19 to be in a position higher than the lower surface of the inkjet head 19 as illustrated in FIG. 2B. At this time, a droplet receiver 31 of the maintenance frame 27 is kept horizontal. When the inkjet head 19 is in the maintenance position, the maintenance frame 27 is moved so as to be located between the lower surface of the inkjet head 19 and the web paper WP as illustrated in FIG. 2D. At this time, the droplet receiver 31 is also kept horizontal. The droplet receiver 31 collects ink droplets ejected from the inkjet head 19 upon flushing, to be mentioned later.

The maintenance frame 27 has an ink-droplet detector 33 on both ends in the plane across the inkjet head 19. The ink-droplet detector 33 detects ink droplets of various sizes that are ejected from the inkjet head 19 upon flushing, to be mentioned later. The ink-droplet detector 33 includes on a first end thereof a light projector 35 and a light receiver 37 on a second end thereof spaced away from the light projector 35 across the inkjet head 19.

The light projector 35 includes a laser diode 37, an optical system 39, and a reflective mirror 41. The laser diode 37 emits laser beams downward. The optical system 39 guides the laser beams from the laser diode 37 to the reflective mirror 41. The reflective mirror 41 reflects the laser beams emitted from upward along the lower surface of the inkjet head 19. The light receiver 37 includes a reflective mirror 43, an optical system 45, and a photodiode 47. The reflective mirror 43 reflects the laser beams upward along the lower surface of the inkjet head 19. In the optical system 45, the laser beams directed upward by the reflective mirror 43 converges to the photodiode 47. The photodiode 47 detects intensity of the laser beams.

The ink-droplet detector 33 mentioned above correspond to an "ink-droplet detecting device" in this invention.

Figure 3:
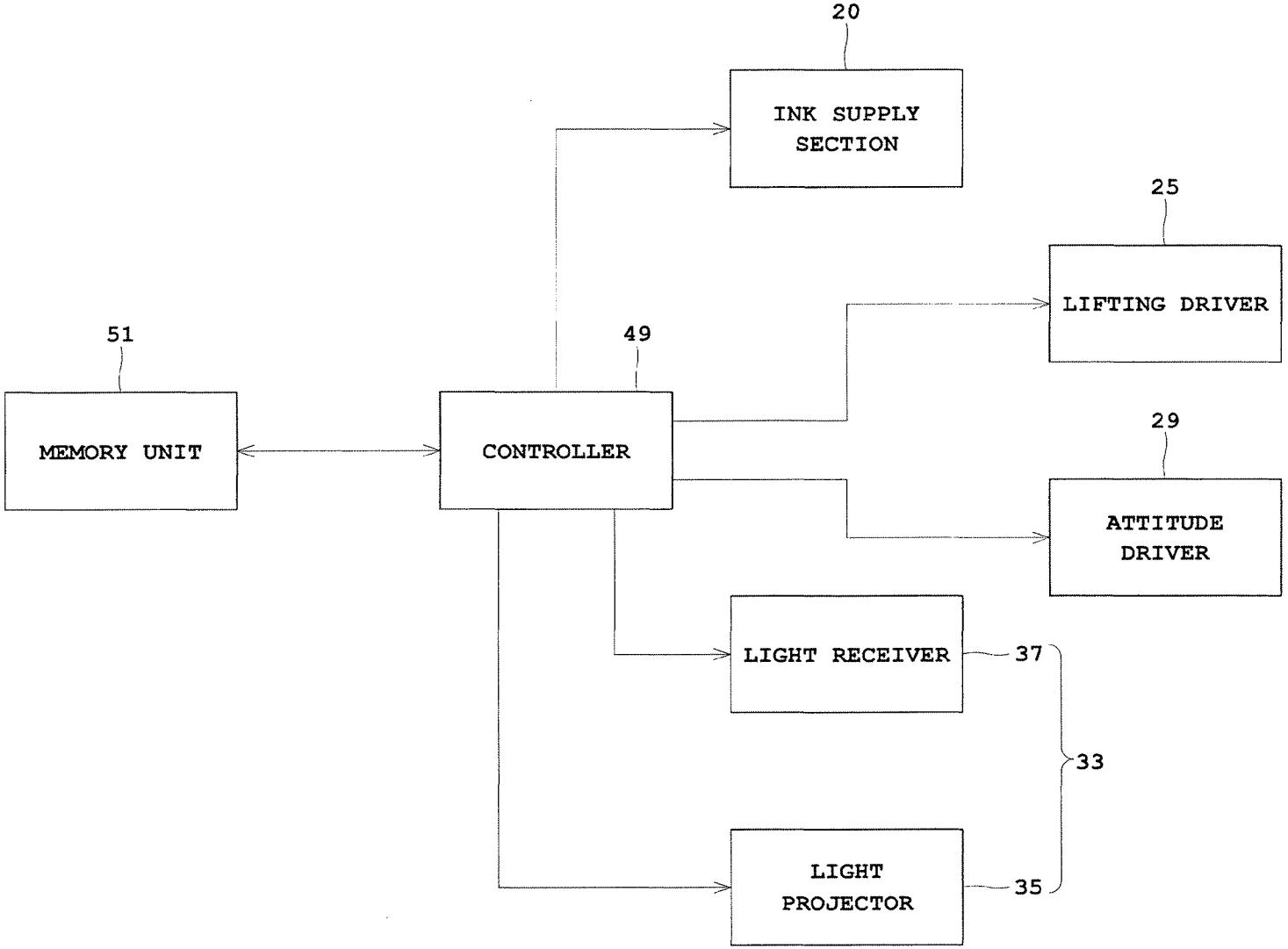
FIG. 3 is a block diagram of a principal part.

As illustrated in the block diagram of the principal part in FIG. 3, the lifting driver 25, the attitude driver 29, the ink-droplet detector 33 (the light projector 35 and the light receiver 37) mentioned above are controlled en bloc by a controller 49. The controller 49 includes a CPU and the like. The controller 49 is connected to a memory unit 51. The memory unit 51 stores in advance program on cleaning, to be mentioned later, and stores results of the ejection test, to be mentioned later, as ejection maps. In addition, the memory unit 51 stores in advance an area for determining group missing, to be mentioned later, as a setting area. The controller 49 also controls the drive roller 7, the drying section 15, the inspecting section 17, or the like. This control is not shown in FIG. 3.

The controller 49 corresponds to a "control device" in this invention.

Figure 4:
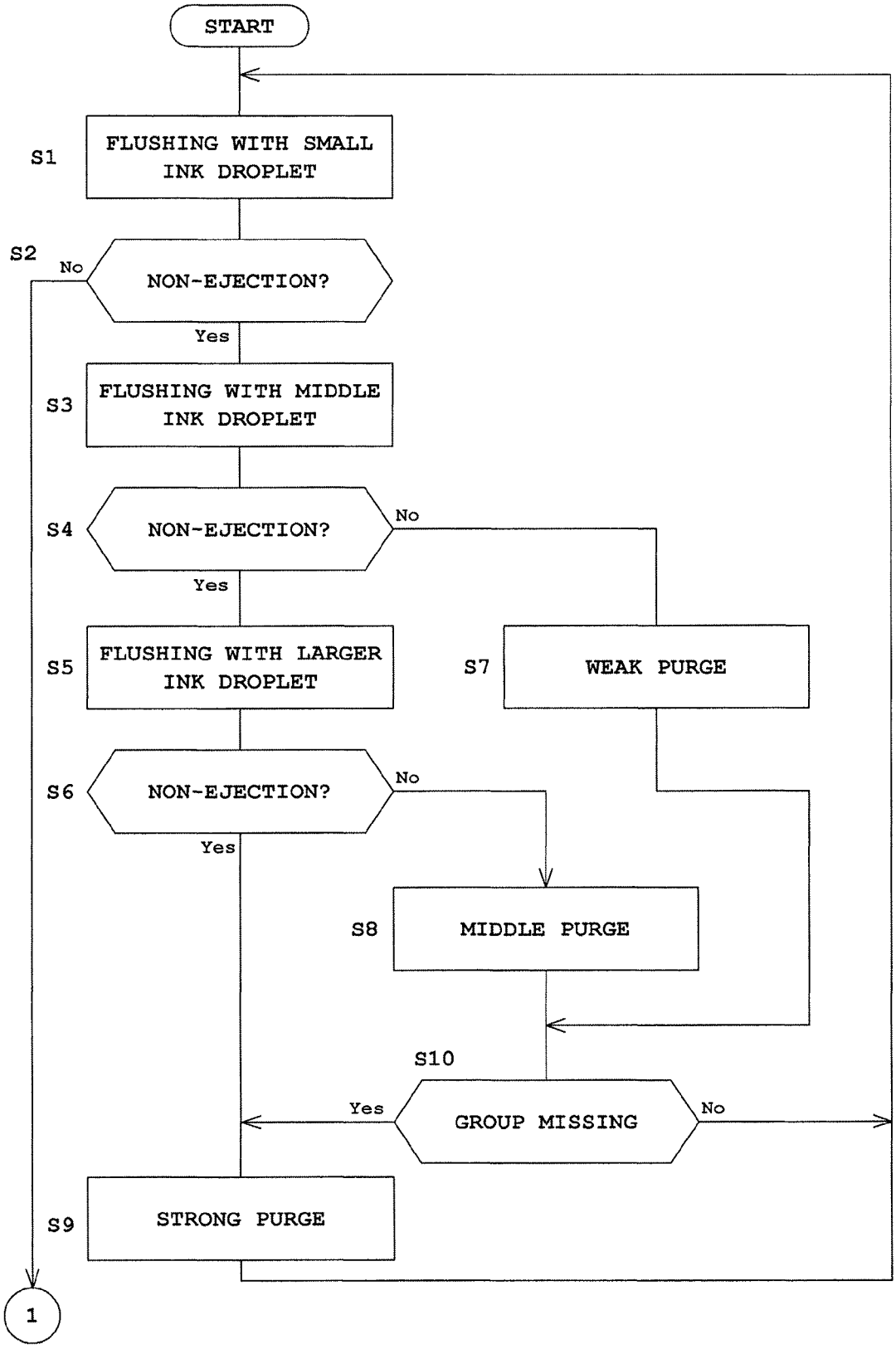
FIG. 4 is a flow chart of flushing prior to printing.
Figure 5:
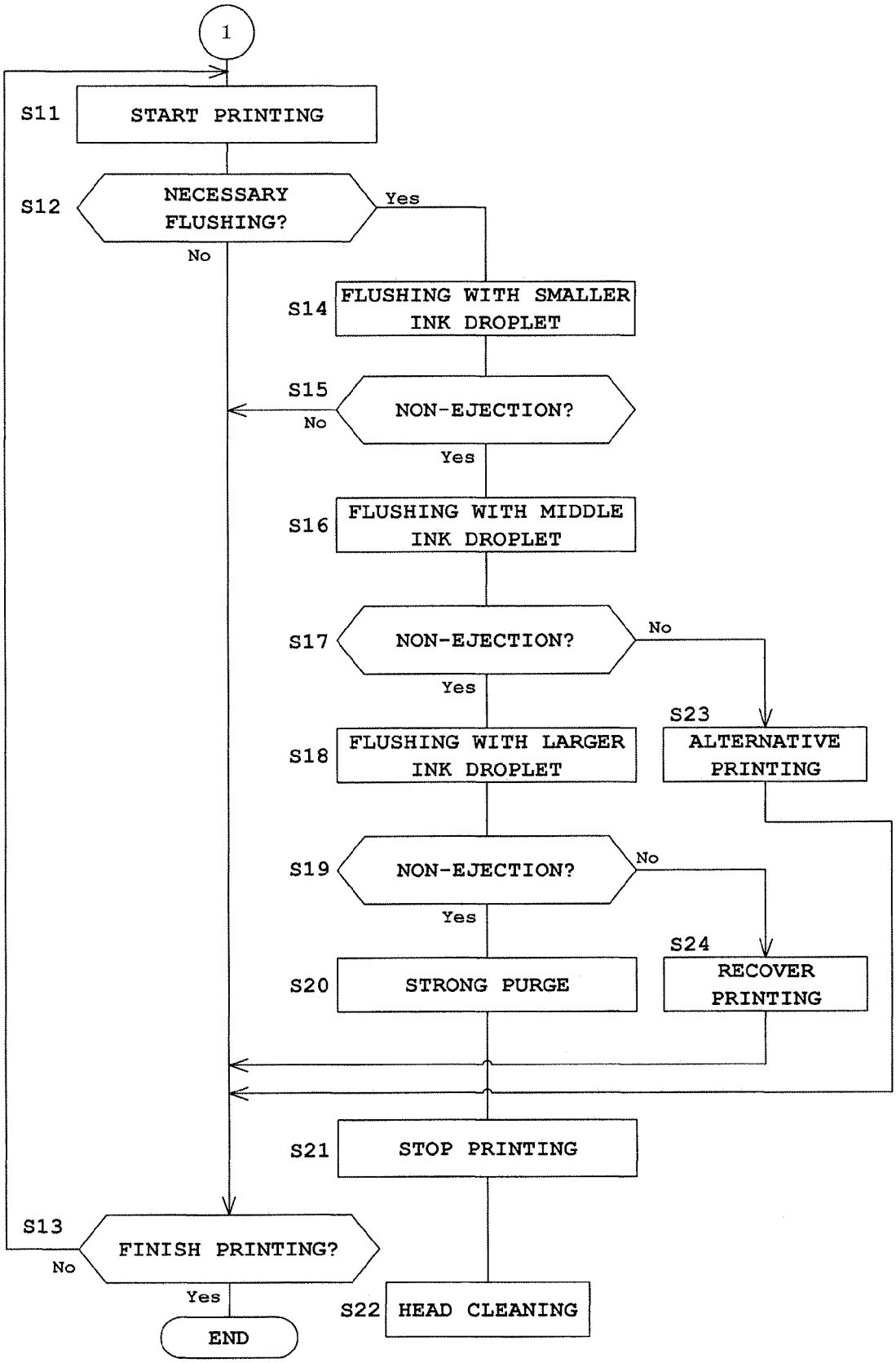
FIG. 5 is a flow chart of flushing during printing.
Figure 6A:
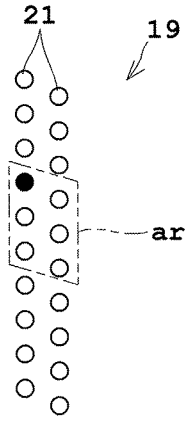
FIG. 6 an explanatory schematic view of group missing: 6A illustrating a setting area, 6B illustrating a condition of group missing, and 6C illustrating a condition of no group-missing.
Figure 6B:
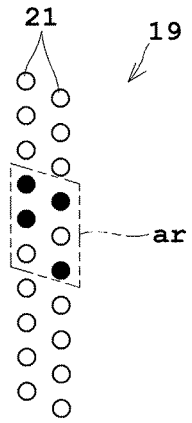
Figure 6C:
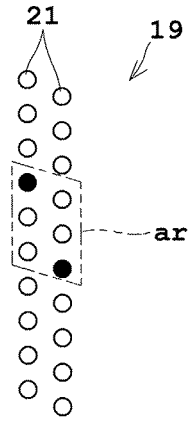

Here, description will be given of cleaning the nozzle 21 in the inkjet printing apparatus 3 with reference to FIGS. 4 to 6. Here, FIG. 4 is a flow chart illustrating flushing prior to printing, whereas FIG. 5 is a flow chart illustrating flushing during printing. FIG. 6 is a schematic view of group missing. FIG. 6A illustrates a setting area. FIG. 6B illustrates a condition of the group missing, and FIG. 6C illustrates a condition of no group-missing.

Description will be given first of cleaning the nozzle 21 prior to printing on the web paper WP with reference to FIG. 4. Here, it is assumed that the inkjet head 19 and the maintenance frame 27 are located in the maintenance position mentioned above.

Steps S1 and S2

The controller 49 operates the ink supply section 20 to perform flushing. Here, flushing is ejection of ink droplets from each of the nozzles 21, which is similar to printing. However, the flushing is not an actual printing on the web paper WP, but is idling in the maintenance position. Specifically, the smaller ink droplets are ejected from each of the nozzles 21 in turn. The smaller ink droplets ejected from each nozzle 21 are collected in the droplet receiver 31.

Here, the smaller ink droplet is an ink droplet with the smallest size that the inkjet head 19 enables to eject. At this time, the smaller ink droplets are ejected from each of the nozzles 21 in turn so as not to be overlapped temporally. Then it is determined in accordance with detection signals from the ink-droplet detector 33 whether or not the small ink droplets are ejected from each of the nozzles 21. The determined result is associated with each of the nozzle 21 to be stored in the memory unit 51.

Here, the controller 49 enables to determine ejection/non-ejection in accordance with intensity of signals from the light receiver 37. Specifically, when the signals from the light receiver 37 have intensity lower than a given threshold (i.e., intensity of zero or extremely low), it is determined that laser beams are interrupted by the ink droplets and thus the smaller ink droplets are ejected from the nozzles 21. On the other hand, when the signals from the light receiver 37 have intensity higher than a given threshold, it is determined that no laser beam is interrupted by the ink droplets, and thus the smaller ink droplets are unejected from the nozzles 21. When the smaller ink droplets are ejected from all the nozzles 21, it is determined that all the nozzles 21 of the inkjet head 19 are normal. Then this process branches to the starting printing (Step S11) in FIG. 7. Here, description will be given on the assumption that at least one nozzle 21 is present from which the smaller ink droplets are unejected.

Steps S3 and S4

Subsequently, the controller 49 operates the ink supply section 20 to perform flushing with the middle ink droplets. The middle ink droplet has a size larger than that of the smaller ink droplet mentioned above and smaller than that of the larger ink droplet to be mentioned later. The controller 49 detects ejection/non-ejection of the middle ink droplets from each of the nozzles 21 at this time, and stores results of the detection associated with each of the nozzles 21 to the memory unit 51.

When the middle ink droplets are ejected from all the nozzles 21, it is determined that the middle ink droplets are normally ejected from all the nozzles 21 of the inkjet head 19 but the smaller ink droplets are not normally ejected. Consequently, the process branches to "weak purge" (Step S7) for recovering ejection of the smaller ink droplets. Here, description will be given on the assumption that at least one nozzle 21 is present from which the middle ink droplets are unejected.

Steps S5 and S6

The controller 49 operates the ink supply section 20 to perform flushing with the larger ink droplets. The larger ink droplet larger in size than the ink droplet mentioned above. For instance, the larger ink droplet is an ink droplet with the largest size that enables to be ejected from the inkjet head 19. The controller 49 detects ejection/non-ejection of the larger ink droplets from each of the nozzles 21 at this time, and stores results of the detection associated with each of the nozzles to the memory unit 51.

When the larger ink droplets are ejected from all the nozzles 21, it is determined that the larger ink droplets are normally ejected from all the nozzles 21 of the inkjet head 19, but the smaller and middle ink droplets are not normally ejected. Consequently, the process branches to "middle purge" for recovering ejection of smaller and middle ink droplets (Step S8). Here, description will be given on the assumption that at least one nozzle 21 is present from which the larger ink droplets are unejected.

Step S9

The controller 49 operates the ink supply section 20 to perform "strong purge" for recovering ejection of smaller, middle, and larger ink droplets. For instance, the ink supply section 20 operates to discharge by suction the ink with which each of the nozzles 21 is filled. This enables to eliminate lumps of the ink droplets or dust over the nozzles 21, resulting in recovering ejection of the ink droplets.

Here, the "strong purge" is performed while the ink supply section 20 gives the maximum suction force or a longer suction period of time. The "middle purge" in Step S7 is performed for a shorter suction period of time than the "strong purge" with suction force lower than or same as that of the "strong purge". The "weak purge" in Step S6 is performed for a shorter suction period of time than the "middle purge" with suction force lower than or same as that of the "middle purge".

Here, the steps S1 to S6 mentioned above correspond to the "ejection test" in this invention. Moreover, the steps S1, S3, and S5 correspond to the "flushing step" in this invention. The steps S2, S4, and S6 correspond to the "non-ejection testing step" in this invention. The steps S7 to S7 correspond to the "non-ejection recovering step" in this invention.

After the steps S7 and S8, the process proceeds to step S10 where group missing is determined. Reference is now made to FIG. 6. FIG. 6 indicates each nozzle 21 in the inkjet head 19 by "○" (empty circle), and a non-ejection nozzle 21 by "●" (filled circle). These circles form an ejection map in the memory unit 51 upon steps S4 and S6. Moreover, an area ar denoted by chain double-dashed lines in FIG. 6 indicates a setting area for determining the group missing.

The controller 49 counts the number of non-ejection nozzles within the setting area ar with respect to each nozzle 21. For instance, as illustrated in FIG. 6A, the setting area ar includes three serial nozzles 21 with respect to one nozzle 21 and three more serial nozzles 21 adjacent to the three nozzles 21. Consequently, as illustrated in FIG. 6B, when the setting area ar contains four non-ejection nozzles 21, it is determined that the area includes group missing. On the other hand, it is determined that the area ar illustrated in FIG. 6A or 6C includes no group missing. The controller 49 operates to perform the strong purge in step S9 when it is determined that the group missing is included. This is because the "group missing" may cause a more significant reason for non-ejection than that when the non-ejection nozzles 21 are distributed. Consequently, non-ejection is not possibly recovered with the weak or middle purge, and thus the strong purge should be conducted. This results in increased accuracy of recovering non-ejection.

After the steps S9 and S10, the process returns to step S1 and the aforementioned processes are repeated until non-ejection of the smaller ink droplets in all the nozzles 21 is eliminated. As noted above, in the ejection test prior to printing, printing is started only when all types in size of ink droplets are ejected. As a result, printing can be achieved with high quality.

Description will be given next of a condition where the smaller ink droplets are ejected from all the nozzles 21 by the foregoing processes with reference to FIG. 5.

Steps S11 to S13

The controller 49 operates the drive roller 7 to feed out the web paper WP. In addition, the controller 49 also operates the lifting driver 25 and the attitude driver 29 to move the inkjet head 19 into the printing position and to move the maintenance frame 27 behind the inkjet head 19. See FIGS. 2A and 2B. Then data on printing is transmitted. In accordance with the data, the ink supply section 20 ejects the ink droplets, and repeatedly ejects the ink droplets until the end of printing (step S11 to S13). During the printing, necessity of flushing is determined between the printing areas (step S12). For instance, the necessity may be determined based on consumption of a given amount of ink, transportation of the web paper WP by a given length, or printing on a given area.

Steps S14 and S15

When it is determined that the flushing is necessary, the controller 49 operates the lifting driver 25 and the attitude driver 29 to move the inkjet head 19 and the maintenance frame 27 into the maintenance position. See FIG. 2B. Subsequently, the flushing is performed for every nozzle 21 with the smaller ink droplets. When all the nozzles 21 eject the smaller ink droplets, the process proceeds to Step S13, and the inkjet head 19 is moved into the printing position where printing is continued.

Steps S16 and S17

When non-ejection is detected through the flushing with the smaller ink droplets, the controller 49 operates to perform flushing with the middle ink droplets. When non-ejection is detected with the smaller ink droplets but is not detected with the middle ink droplets, the process branches to step S23 to shift to "alternative printing", to be mentioned later.

Steps S18 and S19

When non-ejection is detected through the flushing with the smaller and middle ink droplets, the controller 49 operates to perform flushing with the larger ink droplets. When non-ejection is detected with the smaller and middle ink droplets but is not detected with the larger ink droplets, the process branches to step S24 to shift to "recover printing", to be mentioned later.

Step S21 and S22

When all of the smaller, middle, and larger ink droplets are unejected, it is considered that the reason for the non-ejection is significant. Consequently, the controller 49 operates to stop printing and then to clean the head with a wiper, not shown.

Example of the "alternative printing" above include the following.

When the smaller ink droplets are unejected and the middle ink droplets are ejected, the nozzle 21 from with the smaller ink droplets are unejected is replaced with another normal nozzle 21 adjacent to the nozzle 21 for ejecting the smaller ink droplets to be ejected from the non-ejection nozzle 21. As a result, since the nozzles 21 are arranged at small distances and the ink droplets ejected are small, the replaced adjacent nozzles 21 performs similar ejection although the position of the smaller ink droplets to be ejected shifts. Consequently, increased availability can be achieved by continuous printing with certainly maintained printing quality.

Moreover, examples of the "recover printing" above include the following.

When the smaller and middle ink droplets are unejected and the larger ink droplets are ejected, the nozzle 21 from which the smaller and middle ink droplets are unejected is replaced with another normal nozzle 21 adjacent to the nozzle 21 for ejecting the smaller and middle ink droplets to be ejected from the non-ejection nozzle 21. As a result, since the nozzles 21 are arranged at small distances and the smaller and middle ink droplets are of smaller sizes, there exists no apparently significant difference between ejection by the nozzle 21 and that by the adjacent nozzle 21. Consequently, increased availability can be achieved by continuous printing with certainly maintained printing quality.

The controller 49 in the example of this invention operates to perform flushing by ejecting three types in size of ink droplets, i.e., the smaller, middle and larger ink droplets, from each of the nozzles 21. Then the controller 49 operates the ink-droplet detector 33 to perform the ejection test to detect the ejection condition. Thereafter, the controller 49 operates the ink supply section 20 to perform cleaning in accordance with results of the test. A combination in size of the unejected ink droplets indicates a defective condition of the nozzle. Consequently, varying the degree of cleaning the nozzles 21 in accordance with the size of the unejected ink droplets may achieve cleaning in a shorter time of period. As a result, time for cleaning the nozzle 21 can be suppressed. This leads to a decreased proportion of maintenance to a starting time in the apparatus and increased availability of the apparatus.

Moreover, prior to printing, the weak purge is performed when only the smaller ink droplets are unejected. The middle purge is performed when the smaller ink droplets and the middle ink droplets are unejected, and only the larger ink droplets are ejected. The strong purge is conducted when the smaller, middle, and larger ink droplets are all unejected. Thus, the weak purge performed when only the smaller ink droplets are unejected achieves a less purge time than that when the smaller ink droplets and the middle ink droplets are unejected and the larger ink droplets are ejected, or that when the smaller, middle, and bigger ink droplets are all unejected. Moreover, the middle purge performed when the smaller and middle ink droplets are unejected and the larger ink droplets are ejected achieves a less purge time than that when the smaller, middle and larger ink droplets are unejected. Consequently, time for cleaning the nozzle 21 can be suppressed in accordance with conditions of the non-ejection nozzles 21.

This invention is not limited to the example mentioned above, but may be modified as follows.

(1) In the example mentioned above, three types in size of ink droplets, i.e., the smaller, the middle, and the larger ink droplets, are ejected for performing the ejection test. In this invention, however, the ejection test may be performed by ejecting four or more types in size of ink droplets, e.g., the smaller, middle, larger ink droplets mentioned above and additionally extra-larger ink droplets.

(2) In the foregoing example, the ejection test is performed by ejecting three types in size of ink droplets, i.e., the smaller, middle, and larger ink droplets. Alternatively, in this invention, the ejection test may be performed by ejecting two types in size of ink droplets, e.g., the smaller and larger ink droplets. In this case, although it is determined through the ejection test that only the smaller ink droplets have been unejected, the strong purge is preferably performed when the group missing is present in which the non-ejection nozzles of the smaller ink droplets are collected within a given area.

In addition, the ejection test is performed between the printing areas of the web paper WP during printing. When it is determined through the ejection test that only the smaller ink droplets are unejected, the non-ejection nozzle is replaced with another adjacent nozzle and printing is continuously performed with the adjacent nozzle. When it is determined that the larger ink droplets are unejected, the strong purge is firstly performed and thereafter the printing is stopped. Such configuration is preferable.

(2) In the foregoing example, the purge by suction has been described as one example of purge. Alternatively, purge by pressure enables to produce a similar effect to that by the purge by suction.

(3) In the foregoing example, the group missing is determined and the strong purge is performed depending on the non-ejection condition. In this invention, however, it is not always essential to determine the group missing. Consequently, it is not necessary to determine the group missing when the weak or middle purge enables to recover the non-ejection satisfactorily.

(4) In the foregoing example, the setting area ar includes three serial nozzles 21 with respect to a nozzle 21, and additional three serial nozzles 21 in a row adjacent to the three nozzles 21. This invention is not limited to this type of group missing. Moreover, it is assumed here that the group missing includes four non-ejection nozzles 21 in the setting area ar. This invention, however, is not limited to this.

(5) In the foregoing example, the inkjet printing apparatus that performs printing onto the web paper WP in a roll form has been described by way of example. However, this invention is not limited to such the web paper WP, but is applicable to an inkjet printing apparatus that performs printing onto various types of printing sheets.

(6) In the foregoing example, the inkjet printing apparatus has been described by way of example, in the apparatus the maintenance position being above the web paper WP. However, this invention is not limited to such the apparatus. Specifically, this invention is applicable to an apparatus in which the maintenance position is outside of the web paper WP.

INDUSTRIAL UTILITY

As noted above, this invention is suitable for an inkjet printing apparatus that performs printing onto printing paper by ejecting ink droplets and for a head cleaning method of the apparatus.

DESCRIPTION OF REFERENCES

WP . . . web paper
1 . . . paper feeder
3 . . . inkjet printing apparatus
5 . . . take-up roller
7 . . . drive roller
9 . . . transport roller
11 . . . drive roller
13 . . . printing unit
15 . . . drying section
17 . . . inspecting section
19 . . . inkjet head
20 . . . ink supply section
21 . . . nozzle
23 . . . head frame
25 . . . lifting driver
27 . . . maintenance frame
29 . . . attitude driver
31 . . . droplet receiver
33 . . . ink-droplet detector
49 . . . controller
51 . . . memory unit
ar . . . setting area

The invention claimed is:

1. An inkjet printing apparatus that performs printing while moving an inkjet head and a printing sheet relatively to each other, comprising:

an inkjet head with a plurality of nozzles, the nozzles being arranged in a width direction of the printing sheet orthogonal to a relative movement direction of the printing sheet and enabling to eject ink droplets of at least two sizes;

an ink-droplet detector configured to optically detect ink droplets ejected from each of the nozzles; and a non-ejection recovering device configured to recover non-ejection of ink droplets from each of the nozzles; and a controller configured to perform flushing that ejects the ink droplets of at least two sizes from each of the nozzles, to operate the ink-droplet detector to perform an ejection test for detecting an ejection condition of each of the nozzles, and to operate the non-ejection recovering device to perform cleaning in accordance with results of the ejection test, the non-ejection recovering device having a function of cleaning each of the nozzles by purge that discharges the ink droplets, and enables to perform weak purge as weak cleaning and strong purge as stronger cleaning than the weak purge, the controller performing the ejection test of ejecting only the smaller ink droplets and thereafter ejecting only the larger ink droplets relative to each of the nozzles prior to printing, and the controller causing the non-ejection recovering device to perform the weak purge when the ink droplet detector detects a non-ejection nozzle upon the ejection of only the smaller ink droplets, and causing the non-ejection recovering device to perform the strong purge when the ink droplet detector detects a non-ejection nozzle upon the ejection of the larger droplets thereafter through performing the ejection test.

2. The inkjet printing apparatus according to claim 1, wherein the non-ejection recovering device also enables to perform middle purge stronger than the weak purge and weaker than the strong purge, the controller performs the ejection test of ejecting the smaller, middle, and larger ink droplets from each of the nozzles prior to printing, and the controller operates to perform the weak purge when only the smaller ink droplets are unejected, operates to perform the middle purge when the smaller ink droplets and the middle ink droplets are unejected and only the larger ink droplets are ejected, and operates to perform the strong purge when the smaller, middle, and larger ink droplets are all unejected.

3. The inkjet printing apparatus according to claim 2, wherein the controller performs the ejection test and then performs any of the purges, and thereafter performs again the ejection test to start printing only when all types in size of ink droplets are ejected.

4. The inkjet printing apparatus according to claim 2, wherein although it is determined through the ejection test that only the smaller ink droplets are unejected or the smaller ink droplets and the middle ink droplets are unejected from the nozzles, the controller operates to perform the strong purge when the non-ejection nozzles are collected within a given area.

5. The inkjet printing apparatus according to claim 2, wherein the controller performs the ejection test between printing areas of the printing paper, and the controller operates to perform printing continuously by nozzles adjacent to and replaced with the non-ejection nozzles when it is determined through the ejection test that only the smaller ink droplets are unejected, operates to perform printing continuously by the adjacent nozzles when it is determined that the smaller ink droplets and the middle ink droplets are unejected, and operates to perform the strong purge and thereafter to stop the printing when it is determined that the larger ink droplets are unejected.

6. The inkjet printing apparatus according to claim 1, wherein the controller performs the ejection test and then performs any of the purges, and thereafter performs again the ejection test to start printing only when all types in size of ink droplets are ejected.

7. The inkjet printing apparatus according to claim 6, wherein although it is determined through the ejection test that only the smaller ink droplets are unejected from the nozzles, the controller operates to perform the strong purge when the non-ejection nozzles are collected within a given area.

8. The inkjet printing apparatus according to claim 6, wherein although it is determined through the ejection test that only the smaller ink droplets are unejected or the smaller ink droplets and the middle ink droplets are unejected from the nozzles, the controller operates to perform the strong purge when the non-ejection nozzles are collected within a given area.

9. The inkjet printing apparatus according to claim 6, wherein the controller performs the ejection test between printing areas of the printing paper, and the controller operates to perform printing continuously by nozzles adjacent to and replaced with the non-ejection nozzles when it is determined through the ejection test that only the smaller ink droplets are unejected, and the controller operates to perform the strong purge firstly and then stop the printing when it is determined that the larger ink droplets are unejected.

10. The inkjet printing apparatus according to claim 6, wherein the controller performs the ejection test between printing areas of the printing paper, and the controller operates to perform printing continuously by nozzles adjacent to and replaced with the non-ejection nozzles when it is determined through the ejection test that only the smaller ink droplets are unejected, operates to perform printing continuously by the adjacent nozzles when it is determined that the smaller ink droplets and the middle ink droplets are unejected, and operates to perform the strong purge and thereafter to stop the printing when it is determined that the larger ink droplets are unejected.

11. The inkjet printing apparatus according to claim 1, wherein although it is determined through the ejection test that only the smaller ink droplets are unejected from the nozzles, the controller operates to perform the strong purge when the non-ejection nozzles are collected within a given area.

12. The inkjet printing apparatus according to claim 11, wherein the controller performs the ejection test between printing areas of the printing paper, and the controller operates to perform printing continuously by nozzles adjacent to and replaced with the non-ejection nozzles when it is determined through the ejection test that only the smaller ink droplets are unejected, and the controller operates to perform the strong purge firstly and then stop the printing when it is determined that the larger ink droplets are unejected.

13. The inkjet printing apparatus according to claim 1, wherein the controller performs the ejection test between printing areas of the printing paper, and the controller operates to perform printing continuously by nozzles adjacent to and replaced with the non-ejection nozzles when it is determined through the ejection test that only the smaller ink droplets are unejected, and the controller operates to perform the strong purge firstly and then stop the printing when it is determined that the larger ink droplets are unejected.

14. A nozzle cleaning method in an inkjet printing apparatus that performs printing while moving an inkjet head and printing paper relatively to each other, the method comprising:

a flushing step of ejecting ink droplets of at least two sizes from each of a plurality of nozzles in the inkjet head, the nozzles being arranged in a width direction of the printing paper orthogonal to a relative movement direction of the printing paper and enabling to eject ink droplets of at least two sizes;

an ejection-test performing step of optically detecting ink droplets ejected from each of the nozzles; and a non-ejection recovering step of performing one type of cleaning from a plurality of types of cleaning to each of the nozzles for recovering ejection of ink droplets in accordance with results of the ejection test, the ejection-test performing step comprising performing an ejection test of ejecting smaller ink droplets and thereafter ejecting only larger ink droplets relative to each of the nozzles prior to priming, and upon cleaning by purge that ejects the ink droplets relative to each of the nozzles, the non-ejection recovering step comprising performing weak purge as weak cleaning when the ink droplet detector detects a non-ejection nozzle upon the ejecting of only the smaller ink droplets, and performing strong purge as strong cleaning when the ink droplet detector detects a non-ejection nozzle upon the ejection of the larger droplets thereafter in the ejection test step.

15. The nozzle cleaning method according to claim 14, wherein the ejection-test performing step comprising performing an ejection test of ejecting the smaller ink droplets, middle ink droplets, and the larger ink droplets relative to each of the nozzles prior to printing, and the non-ejection recovering step comprises performing the weak purge when only the smaller ink droplets are unejected, performing middle purge stronger than the weak purge and weaker than the strong purge when the smaller ink droplets and the middle ink droplets are unejected and the larger ink droplets are ejected and performing the strong purge when the smaller ink droplets, the middle ink droplets, and the larger droplets are unejected.

* * * * *